US006593893B2

(12) United States Patent
Hou et al.

(10) Patent No.: US 6,593,893 B2
(45) Date of Patent: Jul. 15, 2003

(54) MULTIPLE-BEAM ANTENNA EMPLOYING DIELECTRIC FILLED FEEDS FOR MULTIPLE AND CLOSELY SPACED SATELLITES

(75) Inventors: Peter Hou, Germantown, MD (US); Thomas Jackson, Frederick, MD (US); Jack Lundstedt, Jr., Monrovia, MD (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/736,712

(22) Filed: Dec. 14, 2000

(65) Prior Publication Data

US 2002/0075196 A1 Jun. 20, 2002

Related U.S. Application Data

(60) Provisional application No. 60/187,112, filed on Mar. 6, 2000.

(51) Int. Cl.[7] ..... H01Q 13/02

(52) U.S. Cl. ..... 343/786; 343/755; 343/756; 343/775; 343/785

(58) Field of Search ..... 343/755, 756, 343/772, 775, 779, 781 R, 785, 786; H01Q 13/02

(56) References Cited

U.S. PATENT DOCUMENTS

| | | | | | |
|---|---|---|---|---|---|
| 3,649,934 | A | * | 3/1972 | Matthaei et al. | 333/73 R |
| 3,701,160 | A | * | 10/1972 | Beguin | 343/755 |
| 3,750,182 | A | | 7/1973 | Kernweis | 343/786 |
| 4,468,672 | A | * | 8/1984 | Dragone | 343/783 |
| 4,498,061 | A | * | 2/1985 | Morz et al. | 333/21 A |
| 5,117,240 | A | * | 5/1992 | Anderson et al. | 343/786 |
| 5,166,698 | A | * | 11/1992 | Ashbaugh et al. | 343/783 |
| 6,031,507 | A | * | 2/2000 | Aoki | 343/840 |
| 6,211,842 | B1 | * | 4/2001 | Cousin et al. | 343/840 |

FOREIGN PATENT DOCUMENTS

| | | |
|---|---|---|
| EP | 0 644 608 A2 | 8/1994 |
| EP | 0 843 381 A2 | 5/1998 |
| FR | 2 793 073 A1 | 11/2000 |

* cited by examiner

*Primary Examiner*—Tho Phan

(74) *Attorney, Agent, or Firm*—John T. Whelan; Michael Sales

(57) ABSTRACT

An approach for providing a multiple-beam antenna system for receiving and transmitting electromagnetic signals from a plurality of closely spaced satellites is disclosed. Dielectric inserts are selectively coupled to the feedhorn bodies to alter the radiation patterns according to dielectric constants of the dielectric inserts. A reflector produces multiple antenna beams based upon the altered radiation patterns of the feedhorn bodies. The antenna provides simultaneous transmissions to satellites that are spaced about 2° or less.

19 Claims, 5 Drawing Sheets

MULTIPLE-BEAM ANTENNA EMPLOYING DIELECTRIC FILLED FEEDS FOR MULTIPLE AND CLOSELY SPACED SATELLITES

CROSS-REFERENCES TO RELATED APPLICATION

This application is related to, and claims the benefit of the earlier filing date of U.S. Provisional Patent Application Serial No. 60/187,112, filed Mar. 6, 2000, entitled "Multiple-Beam Antenna Employing Dielectric Filled Feeds for Multiple and Closely Spaced Satellites," which is incorporated herein by reference in its entirety.

BACKGROUND OF THE INVENTION

1. Field of the Invention

The present invention relates generally to satellite communication systems, and is more particularly related to an antenna utilizing feedhorns to transmit and receive signals.

2. Discussion of the Background

Reflector antennas are typically deployed to receive and transmit signals to a communication satellite. Two key components of the reflector antenna are the feed system and the reflector. Depending on the mode of operation (i.e., receiving or transmitting), the feed system either illuminates the reflector, which in turn, collimates the radiation from the feed system to provide an antenna beam, or receives concentrated signals from the reflector. Given the wide deployment of satellite communication systems, it is increasingly important to implement a multiple-beam antenna to exchange signals with multiple satellites using a single antenna.

To simultaneously receive and/or transmit signals to multiple satellites, numerous feedhorns or "feeds" are utilized. The number of satellites that an antenna can simultaneously communicate with depends largely on the number of feedhorns that can physically be mounted on the antenna. Thus, the size of the feedhorns plays an important role in designing a multiple beam antenna.

Another consideration in the design of the multiple beam antenna concerns the capability of the antenna to perform 2-way communication with closely spaced satellites. Current Federal Communications Commission (FCC) regulations allow a minimum spacing of 2° between satellites.

One conventional approach employs a dielectric loaded low-noise block converter with feed (LNBF) into the antenna to simultaneously receive signals from different satellites. A drawback with this approach is that the LNBF feed only supports simultaneous reception, not transmission; thus, application of this antenna is limited. Another drawback is that this antenna design is limited to a minimum satellite spacing of about 4°.

Another traditional antenna uses a corrugated feedhorn with twin waveguide openings (known as a "Siamese feed"). As with the above LNBF antenna, this antenna can only receive simultaneously from multiple satellites. Because of the relatively poor performance of this feed, this antenna is not suitable for transmit purposes, as it cannot meet the antenna transmit performance standards set by the FCC (or other regulatory authorities outside the United States). Therefore, this type of feed currently is utilized for receive operation only, as the FCC and other authorities do not presently promulgate mandatory receive antenna performance standards.

Based on the foregoing, there is a clear need for improved approaches for providing multiple beam antennas that can transmit and receive to different satellites, simultaneously.

There is also a need to increase the number of beams that are supported by a single antenna.

There is also a need to enhance performance of the antenna to provide full-duplex communicate with satellites that are spaced less than or equal to 2°.

Based on the need to increase antenna efficiency and minimize cost, an approach for providing a single antenna that simultaneously transmits and receives to multiple satellites is highly desirable.

SUMMARY OF THE INVENTION

According to one aspect of the invention, an antenna apparatus for receiving and transmitting electromagnetic signals from a plurality of closely spaced satellites comprises a feedhorn that is configured to generate a radiation pattern. A dielectric insert is coupled to the feedhorn to alter the radiation pattern of the feedhorn according to the dielectric constant of the dielectric insert. A reflector is configured to produce an antenna beam based upon the altered radiation pattern of the feedhorn. The above arrangement advantageously provides enhanced performance of the antenna system by increasing the number of simultaneous beams per antenna.

According to another aspect of the invention, a method is provided for receiving and transmitting electromagnetic signals from a plurality of closely spaced satellites via a single antenna. The method includes generating a radiation pattern using a feedhorn of the antenna, wherein the feedhorn is coupled to the dielectric insert that alters the radiation pattern of the feedhorn according to a dielectric constant of the dielectric insert. The method also includes producing an antenna beam based upon the generated radiation pattern via a reflector of the antenna. Under this approach, system cost is reduced because the need to use multiple antennas for communicating with different satellites is eliminated.

According to another aspect of the invention, a multiple-beam antenna system for receiving and transmitting electromagnetic signals from a plurality of closely spaced satellites comprises a plurality of feedhorns having respective radiation patterns. Each of the feedhorns has an aperture and a body. A plurality of dielectric inserts are selectively coupled to the plurality of feedhorns to alter the radiation patterns according to dielectric constants of the dielectric inserts. A reflector is configured to produce multiple antenna beams based upon the altered radiation patterns of the feedhorns. The above arrangement advantageously enhances efficiency of the satellite terminals.

In yet another aspect of the invention, an antenna apparatus for receiving and transmitting electromagnetic signals from a plurality of closely spaced satellites comprises a feedhorn that is configured to generate a radiation pattern. A dielectric insert is coupled to the feedhorn to reduce an effective feed aperture size according to a dielectric constant of the dielectric insert. A reflector is configured to produce an antenna beam. This approach reduces the effective aperture size, thereby permitting physically closed spaced feeds, which in turn can generate antenna beams as close as 2°.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

In the following description, for the purpose of explanation, specific details are set forth in order to provide a thorough understanding of the invention. However, it will be apparent that the invention may be practiced without these specific details. In some instances, well-known structures and devices are depicted in block diagram form in order to avoid unnecessarily obscuring the invention.

Figure 1:
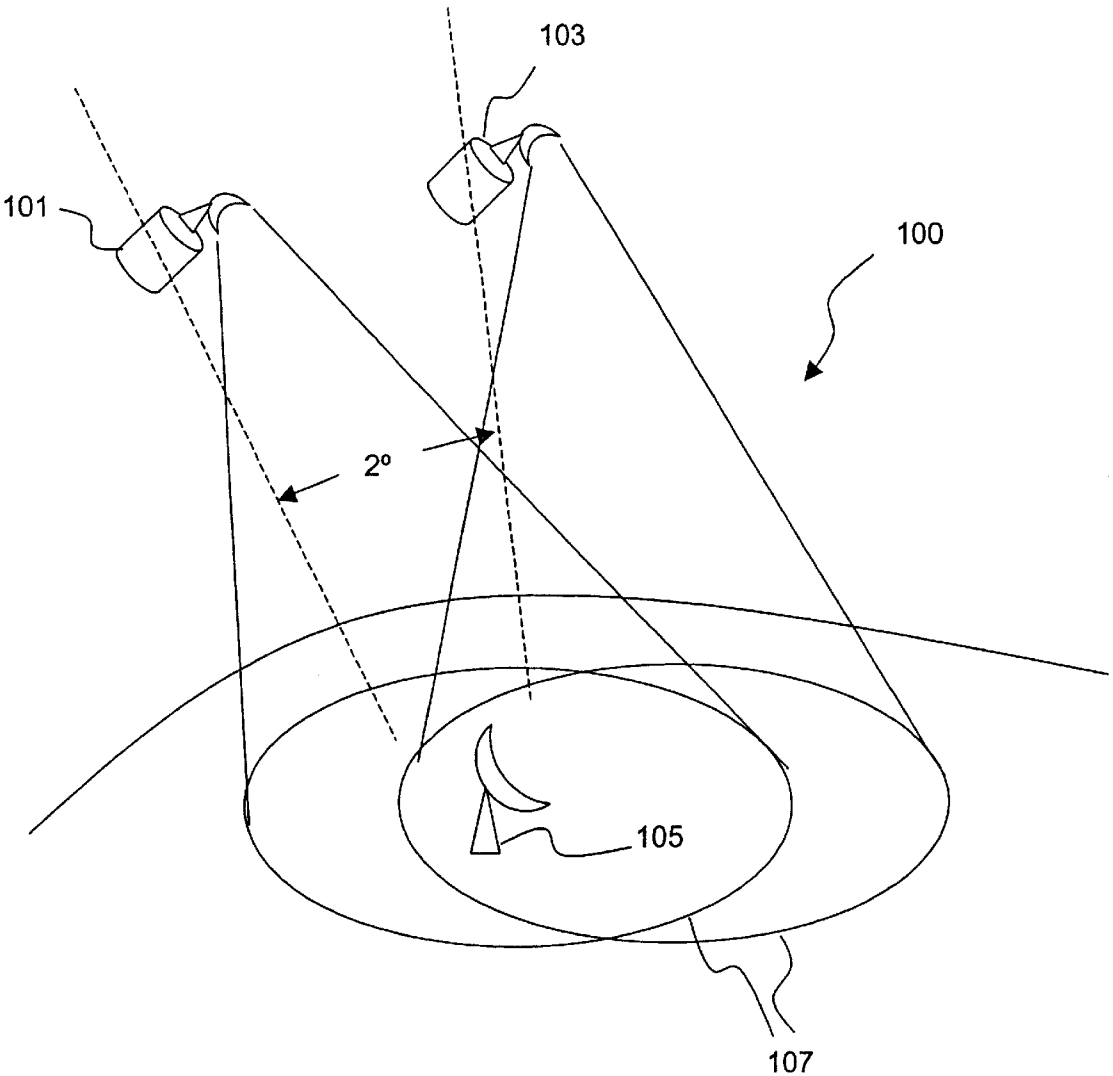
FIG. 1 is a diagram of satellite communication system with multiple satellites spaced approximately 2° apart, according to an embodiment of the present invention.

The present invention uses multiple dielectric loaded feedhorns to enable simultaneous communication between a multiple beam earth-station antenna and multiple satellites that are closely spaced. The dielectric inserts reduce the dimensions of the feedhorns inversely with the square-root of the dielectric constant of the dielectric inserts. FIG. 1 is a diagram of satellite communication system with satellites spaced approximately 2° apart, according to an embodiment of the present invention.

Within system 100 are two geosynchronous satellites 101 and 103, which are stationary above the earth's equatorial plane. In their geostationary positions, the satellites 101 and 103 are spaced approximately 2° of arc apart, with a variance of 5%–10% when viewed from earth. Thus, the angular spacing ranges from about 1.9° to 2.2° when viewed from earth.

The system 100, in an exemplary embodiment, operates in the 29.5–30.0 GHz Earth to Space direction and operates in the 19.7–20.2 GHz Space to Earth direction (i.e., "A" band). A satellite terminal (ST) 105 within coverage area 107 transmits and receives data at a variety of rates (e.g., 512 kbps, 2 Mbps, and 16 Mbps) to the satellites 101 and 103. All transmission rates use Offset QPSK modulation; filtering is 25 percent raised root cosine. Alternatively, the satellites 101 and 103 may utilize C-band (4.0 GHz–8 GHz) or Ku-band (12.0 GHz–18 GHz) downlink frequencies.

As will be more fully described later, ST 105 can simultaneously communicate with the satellites 101 and 103, despite the close degree of spacing. This advantageously eliminates the need for the ST 105 to utilize two separate dishes to receive service from different satellites.

The service area 107 is covered by a set of polygons (not shown) that are fixed on the surface of the earth. Downlink polygons, called microcells, are hexagonal in shape as viewed from the spacecraft, with seven microcells clustered together to form an uplink polygon, called a cell. As used herein, the term microcell is used synonymously with the term downlink cell. The satellite generates a set of uplink circular beams that each encloses a cell. It also generates a set of downlink beams that each encloses a microcell.

Downlink packet bursts to individual microcells are transmitted with sufficient power to just close the link to an ST 105 within the microcell. In addition, there is a "cellcast" mode that is used to transmit system-level information to all STs (of which only ST 105 is shown). The transmit power to the center microcell is increased sufficiently to close the link to STs in any of the seven microcells within the uplink cell.

Polarization is employed by the communication system 100 to maximize the system capacity. The polarization is fixed, as are the satellite beams that serve the cells. Adjacent cells or cells that are separated by less than one cell diameter of the same polarization must split the spectrum; that is, such cells cannot use the same frequencies. However, adjacent cells on opposite polarization can use the same frequencies. The downlink beam operates on two polarizations simultaneously so that the frequency reuse ratio is 2:1. A total of 24 transmitters, 12 on RHC (Right-Hand Circular) polarization and twelve on the LHC (Left-Hand Circular) polarization serve the downlink cells. The transmitters serve all microcells by time hopping from microcell to microcell. With 24 transmitters, the theoretical frequency reuse ratio is 24:1.

Up to 12 downlink spot beams can be transmitted simultaneously on each polarization subject to minimum microcell separation distance limitations. Beams on the same polarization must be sufficiently separated spatially to avoid unacceptable co-channel interference. Another co-polarized beam is not allowed to transmit to another microcell within an ellipse or else excessive interference may occur. The "keep-out" areas apply separately and independently for the two polarizations; the link budgets account for any cross-polarization interference that may occur.

To simultaneously transmit and/or receive signals from the closely spaced satellites 101 and 103, ST 105 employs an antenna that employs multiple feedhorns that are inserted with dielectric material.

Figure 2:
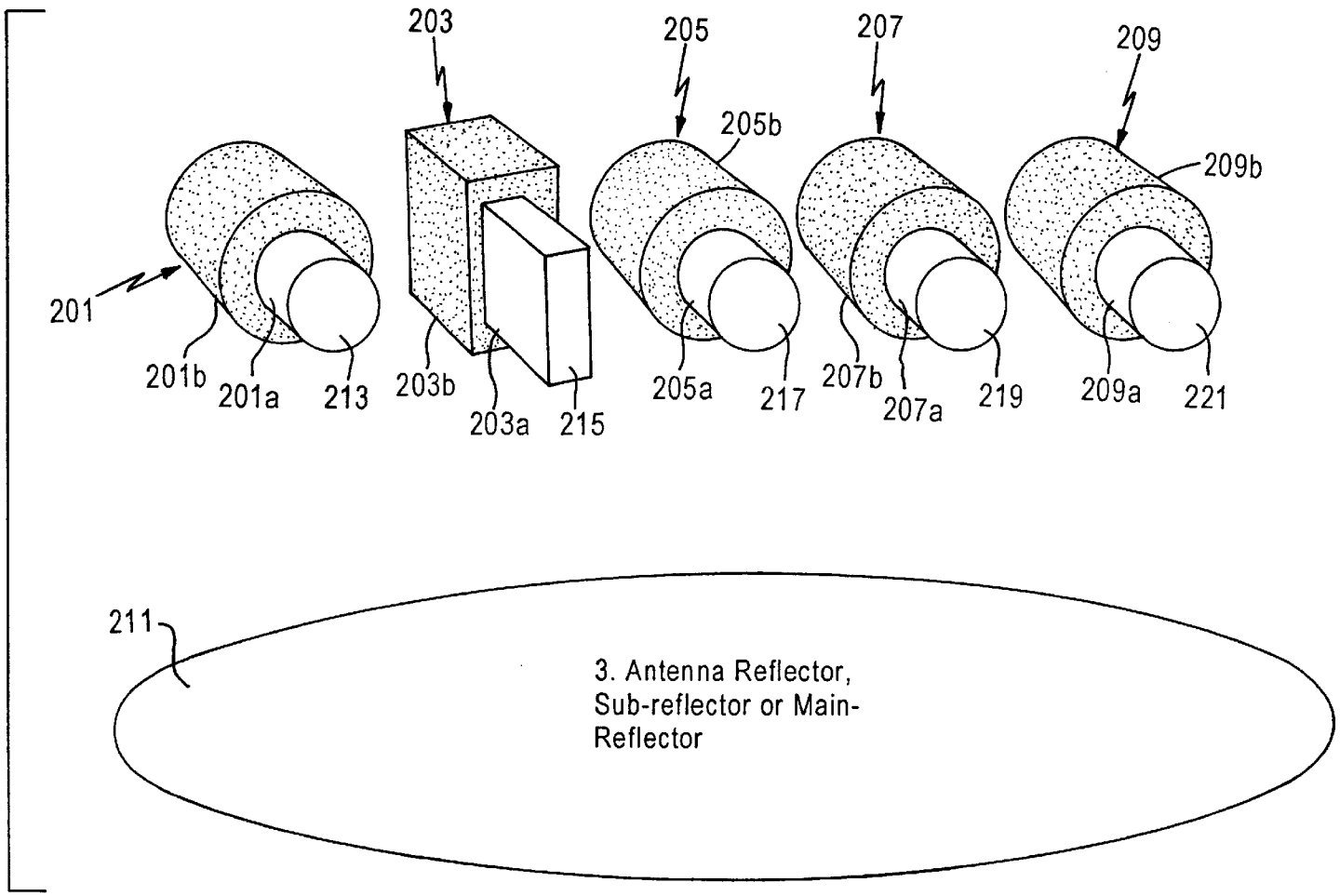
FIG. 2 is a diagram of multiple dielectric loaded feedhorns, according to an embodiment of the present invention.

FIG. 2 is a diagram of multiple dielectric loaded feedhorns, according to an embodiment of the present invention. In this example, five feedhorns 201, 203, 205, 207, and 209 are ganged together about the focal point of a reflector 211. Any number of feedhorns may be employed in a single antenna (not shown) depending on the number of desired simultaneous beams, limited only by the physical dimensions of the collection of feedhorns and the reflector 211. The feedhorns 201, 203, 205, 207, and 209 generate radiation patterns (or antenna primary patterns) that illuminate the reflector 211 in a prescribed manner.

Accordingly, the feedhorns 201, 203, 205, 207, and 209 are the basic transducers that transmit and receive electromagnetic energies; in which the direction of this electromagnetic energy flow and the distributions of the associated energy density and phase constitute the antenna primary patterns.

The radiation patterns are primarily dictated by the size and shapes of the apertures (or openings) 201*a*, 203*a*, 205*a*, 207*a*, and 209*a*, the length and taper angle of the feedhorn bodies 201*b*, 203*b*, 205*b*, 207*b*, and 209*b*, and the presence of corrugation(s) on the feedhorn surface.

The aperture of the feedhorn bodies 201*b*, 203*b*, 205*b*, 207*b*, and 209*b* may take any number of shapes; e.g., circular, elliptical, square, rectangular, polygonal, or irregular. In particular, feedhorn 201 has a cylindrical feedhorn body 201*b* and a corresponding dielectric insert 213, which is also cylindrical in shape. Feedhorn 203 has a rectangular feedhorn body 203*b* and contains a rectangular dielectric insert 215. The other feedhorns 205, 207, and 209 are identical to feedhorn 201 and possess respective cylindrical inserts 217, 219, and 221.

The physical spacing between neighboring feedhorns 201, 203, 205, 207, and 209 can be of any dimension. Additionally, the spacings need not be uniform. For example the feedhorns 201, 203, 205, 207, and 209 may even be in contact.

A dielectric insert (e.g., 213, 215, 217, 219, and 221), when loaded into a feedhorn body, enables the feedhorn to generate radiation patterns that are comparable to a much larger feedhorn. Conversely, an equivalent radiation pattern may be generated using a smaller feedhorn. As a first approximation, the factor, $f$, by which the feedhorn can be reduced is governed by the following equation:

$$f \; 1/(\in_r)^{1/2},$$

where $\in_r$ represents the dielectric constant. In an exemplary embodiment, the $\in_r$ ranges from 2.7 to 1,000. For purposes of illustration, assuming the dielectric insert is made of a dielectric material with a dielectric constant of 4, then a feedhorn having a 1" diameter aperture can generate radiation patterns that are similar to a feed horn with a 2" diameter aperture.

The implementation of the dielectric inserts is quite flexible. The dielectric inserts 213, 215, 217, 219, and 221 may have any shape and size, independent of the shape and size of the feedhorns 201, 203, 205, 207, and 209. These dielectric inserts 213, 215, 217, 219, and 221 may completely fill or partially fill the cavities of the feedhorn bodies 201*b*, 203*b*, 205*b*, 207*b*, and 209*b*. Further, the dielectric inserts 201, 203, 205, 207, and 209 may be external to the cavities of the feedhorn bodies 201*b*, 203*b*, 205*b*, 207*b*, and 209*b*; i.e., the insert behaves as a dielectric lense. The materials for the dielectric inserts 213, 215, 217, 219, and 221 include the following: polymer, glass, quartz, rubber, wood, paper, any composite material, any semi-conductor, any non-conductor, or any conductor.

Although the feedhorns 201, 203, 205, 207, and 209, as shown in FIG. 2, possess dielectric inserts 213, 215, 217, 219, and 221, it is noted that not all of the feedhorns 201, 203, 205, 207, and 209 necessarily require such inserts 213, 215, 217, 219, and 221. This aspect of the present invention is more fully discussed in FIG. 3.

Figure 3:
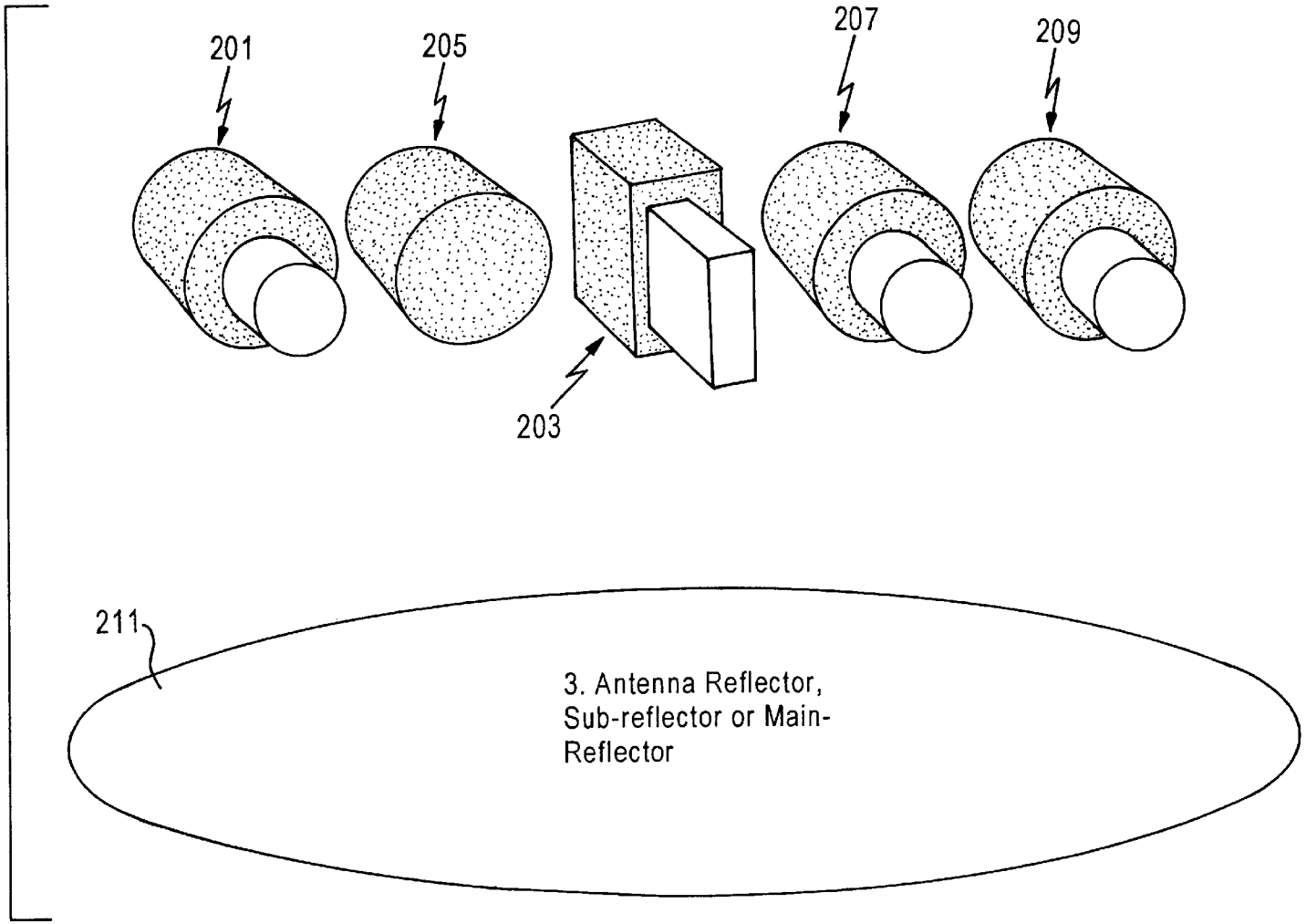
FIG. 3 is a diagram of multiple feedhorns in which dielectric inserts are selectively loaded therein, in accordance with an embodiment of the present invention.

FIG. 3 shows a diagram of multiple feedhorns in which dielectric inserts are selectively loaded, in accordance with an embodiment of the present invention. In FIG. 3, the feedhorns 201, 203, 205, 207, and 209 of FIG. 2 are reordered. In particular, the positions of rectangular feedhorn 203 and the feedhorn 205 are transposed. Unlike the arrangement of FIG. 2, feedhorn 205 does not have a dielectric insert.

Figure 4:
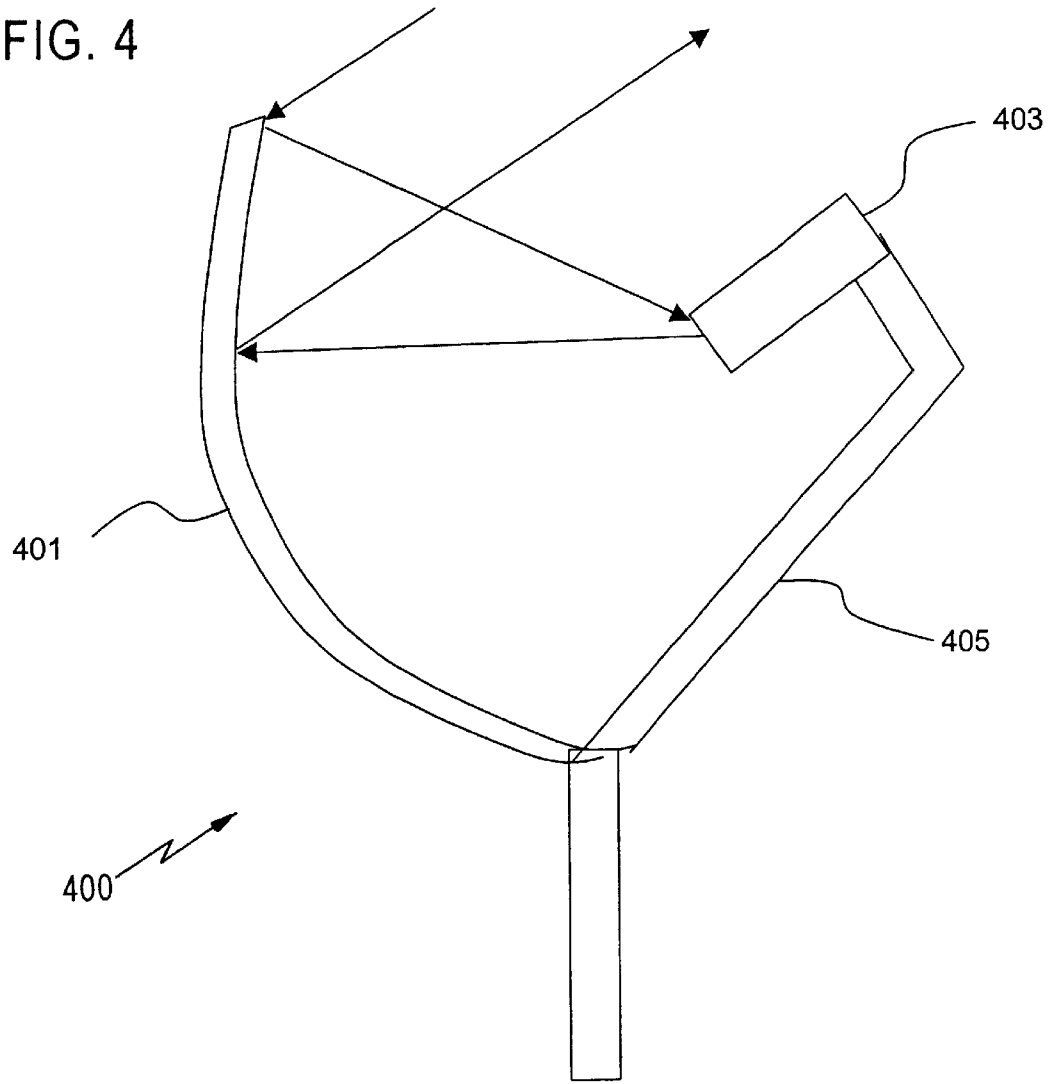
FIG. 4 is a diagram of a reflector antenna utilizing the multiple dielectric loaded feedhorns, in accordance with an embodiment of the present invention.

FIG. 4 is a diagram of a reflector antenna utilizing the multiple dielectric loaded feedhorns, in accordance with an embodiment of the present invention. A parabolic reflector antenna 400 includes a reflector 401 and multiple dielectric filled feedhorns 403, which are positioned with an arm 405. The feedhorns 403 are positioned at the focal point of the parabolic reflector 401.

Figure 5:
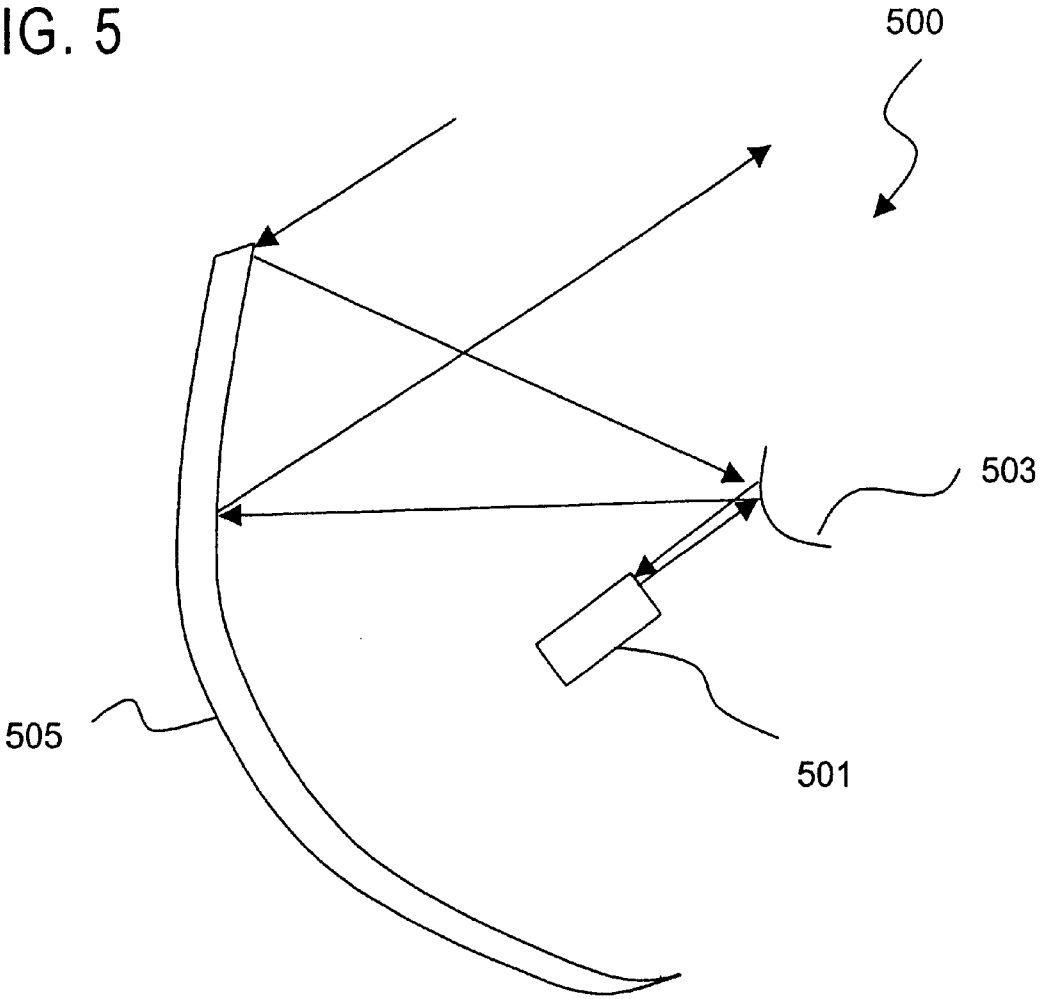
FIG. 5 is a diagram of a reflector antenna having a sub-reflector and main reflector utilizing the multiple dielectric loaded feedhorns, in accordance with an embodiment of the present invention.

FIG. 5 is a diagram of a reflector antenna having a sub-reflector and main reflector utilizing the multiple dielectric loaded feedhorns, in accordance with an embodiment of the present invention. Reflector 500 utilizes multiple dielectric filled feedhorns 501 that radiate, during transmission, to a sub-reflector 503. The sub-reflector 503 directs the electromagnetic energy from the feedhorns 501 to a main reflector 505.

The techniques described herein provide several advantages over prior approaches to communicating with closely spaced satellites. The antenna utilizes ganged multiple feedhorns to receive and transmit electromagnetic energy from satellites that are spaced 2° or less apart. To overcome the physical constraint on the size of the feedhorns, dielectric inserts are used to fill the feedhorns. This approach advantageously provides the capability to simultaneous communicate with multiple satellites using a single antenna, thereby reducing system costs.

Obviously, numerous modifications and variations of the present invention are possible in light of the above teachings. It is therefore to be understood that within the scope of the appended claims, the invention may be practiced otherwise than as specifically described herein.

What is claimed is:

1. A method of receiving and transmitting electromagnetic signals from a plurality of satellites via a single antenna, the method comprising:

generating a plurality of radiation patterns using a corresponding plurality of feedhorns of the antenna, wherein each of the feedhorns is coupled to a dielectric insert that alters the corresponding radiation pattern according to a dielectric constant of the dielectric insert to permit simultaneous transmission and reception of the signals; and producing a plurality of antenna beams based upon the generated radiation patterns via a reflector of the antenna to communicate with the plurality of satellites, wherein the plurality of satellites are spaced 2.0° or less apart.

2. The method according to claim 1, wherein one of the plurality of feedhorns in the generating step has an aperture of a predetermined shape, the predetermined shape being at least one of a circular shape, an elliptical shape, a square shape a rectangular shape, and a polygonal shape.

3. The method according to claim 1, wherein one of the plurality of feedhorns in the generating step has a body with a shape that is at least one of a circular shape, an elliptical shape, a square shape, a rectangular shape, and a polygonal shape.

4. The method according to claim 1, wherein the dielectric insert in the generating step has a shape that is independent of a shape of the corresponding feedhorn.

5. The method according to claim 1, wherein the dielectric insert in the generating step completely fills a cavity of the corresponding feedhorn.

6. The method according to claim 1, wherein the dielectric insert in the generating step partially fills a cavity of the corresponding feedhorn.

7. The method according to claim 1, wherein the dielectric insert in the generating step is situated external to a cavity of the corresponding feedhorn.

8. The method according to claim 1, wherein the dielectric insert in the generating step is made of at least one of polymer, glass, rubber, wood, and a composite material.

9. The method according to claim 1, wherein the dielectric insert in the generating step is made of at least one of a non-conductor, a semi-conductor, and a conductor.

10. The method according to claim 1, wherein the dielectric constant ranges from about 2.7 to about 1,000.

11. A multiple-beam antenna system for receiving and transmitting electromagnetic signals from a plurality of satellites, comprising:

a plurality of feedhorns having respective radiation patterns, each of the plurality of feedhorns an aperture and a body;

a plurality of dielectric inserts selectively coupled to the plurality of feedhorns to alter the radiation patterns according to dielectric constants of the dielectric inserts to permit simultaneous transmission and reception of the signals; and a reflector configured to produce multiple antenna beams based upon the altered radiation patterns of the feedhorns to communicate with the plurality of satellites, wherein the plurality of satellites are spaced 2.0° or less apart.

12. The system according to claim 11, wherein each of the apertures has a predetermined shape, the predetermined shape being at least one of a circular shape, an elliptical shape, a square shape, a rectangular shape, and a polygonal shape.

13. The system according to claim 11, wherein each of the feedhorn bodies has a shape that is at least one of a circular shape, an elliptical shape, a square shape, a rectangular shape, and a polygonal shape.

14. The system according to claim 11, wherein the plurality of feedhorn bodies are spaced according to a predetermined distance.

15. The system according to claim 11, wherein each of the plurality of dielectric inserts has a shape that is independent of the shapes of the feedhorn bodies and the shapes of the apertures.

16. The system according to claim 11, wherein one of the plurality of dielectric inserts completely fills a cavity of one of the plurality of feedhorn bodies.

17. The system according to claim 11, wherein one of the plurality of dielectric inserts partially fills a cavity of one of the plurality of feedhorn bodies.

18. The system according to claim 11, wherein one of the plurality of dielectric inserts is situated external to a cavity of one of the plurality of feedhorn bodies.

19. The system according to claim 11, wherein each of the dielectric inserts has a dielectric constant from about 2.7 to about 1,000.

* * * * *